US005682625A

United States Patent [19]

Leaverton et al.

[11] Patent Number: 5,682,625

[45] Date of Patent: Nov. 4, 1997

[54] HOT TUB WITH ADJUSTABLE HEADREST WITH WATER JET

[75] Inventors: Gregg Leaverton, Oceanside; Jeff Knight, La Costa, both of Calif.

[73] Assignee: Dimension One Spas, Inc., Oceanside, Calif.

[21] Appl. No.: 595,488

[22] Filed: Feb. 1, 1996

Related U.S. Application Data

[63] Continuation of Ser. No. 542,639, Oct. 13, 1995, abandoned.

[51] Int. Cl.[6] ..... A47K 3/00

[52] U.S. Cl. ..... 4/541.1; 4/541.3; 4/546; 4/559

[58] Field of Search ..... 4/541.1, 541.3, 4/541.4, 541.5, 541.6, 546, 547, 559, 575.1; 601/148, 149, 150, 151, 152, 153

[56] References Cited

U.S. PATENT DOCUMENTS

| | | | |
|---|---|---|---|
| 4,313,432 | 2/1982 | Sievers | 128/37 |
| 4,339,833 | 7/1982 | Mandell | 4/541.6 |
| 4,389,740 | 6/1983 | Henry | 4/575.1 |
| 4,599,753 | 7/1986 | Goodman | 4/541.3 |
| 4,763,367 | 8/1988 | Henkin et al. | 4/542 |
| 4,764,999 | 8/1988 | Rushing | 4/542 |
| 4,825,854 | 5/1989 | Henkin et al. | 128/66 |
| 4,839,930 | 6/1989 | Watkins | 4/541.1 |
| 5,333,324 | 8/1994 | Pinciaro | 4/567 |
| 5,335,375 | 8/1994 | Madson, Jr. | 4/541.6 |

*Primary Examiner*—David J. Walczak
*Attorney, Agent, or Firm*—Rodney F. Brown

[57] ABSTRACT

An adjustable headrest for a spa tub includes a housing defining a first recess for receiving a pillow for supporting the head of an occupant. A spa tub defines a second recess for slidingly receiving the housing. A positioning device, coupled to the housing and the recess of the spa tub, allows adjustment of the height of the housing relative to the spa tub. A front surface of the housing and the pillow lie flush with adjacent surfaces of the spa tub. The adjustable headrest further includes a water jet, mounted on the housing below the pillow, for directing water (but preferably not air to reduce splashing) under pressure towards the neck of the occupant. The direction of the water leaving the water jet can be adjusted.

18 Claims, 3 Drawing Sheets

Fig. 2
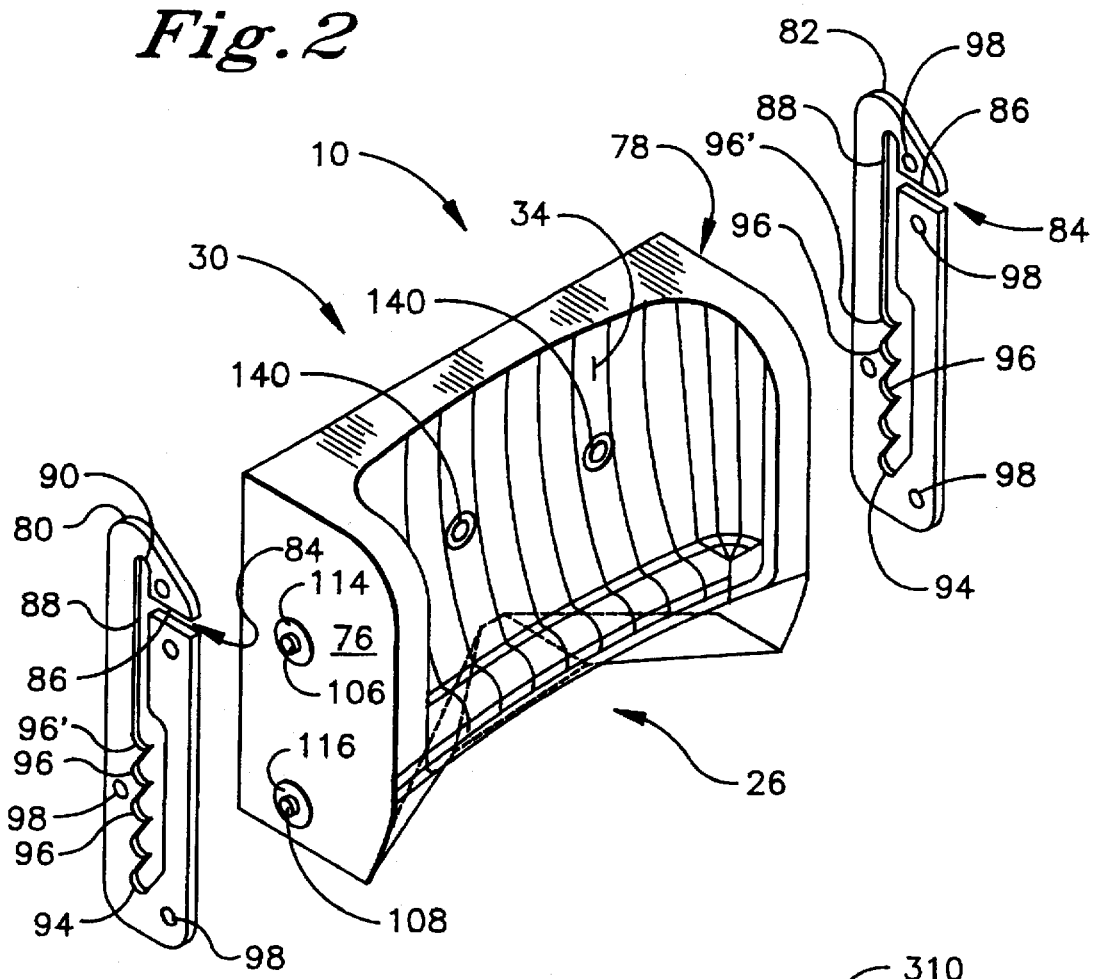
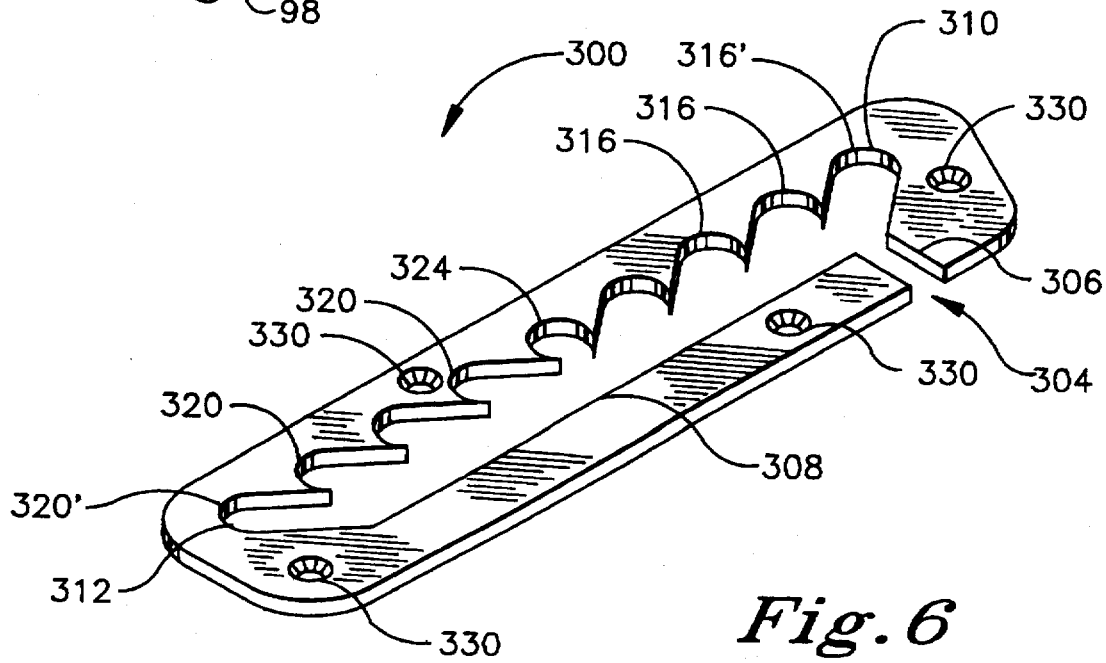
Fig. 6

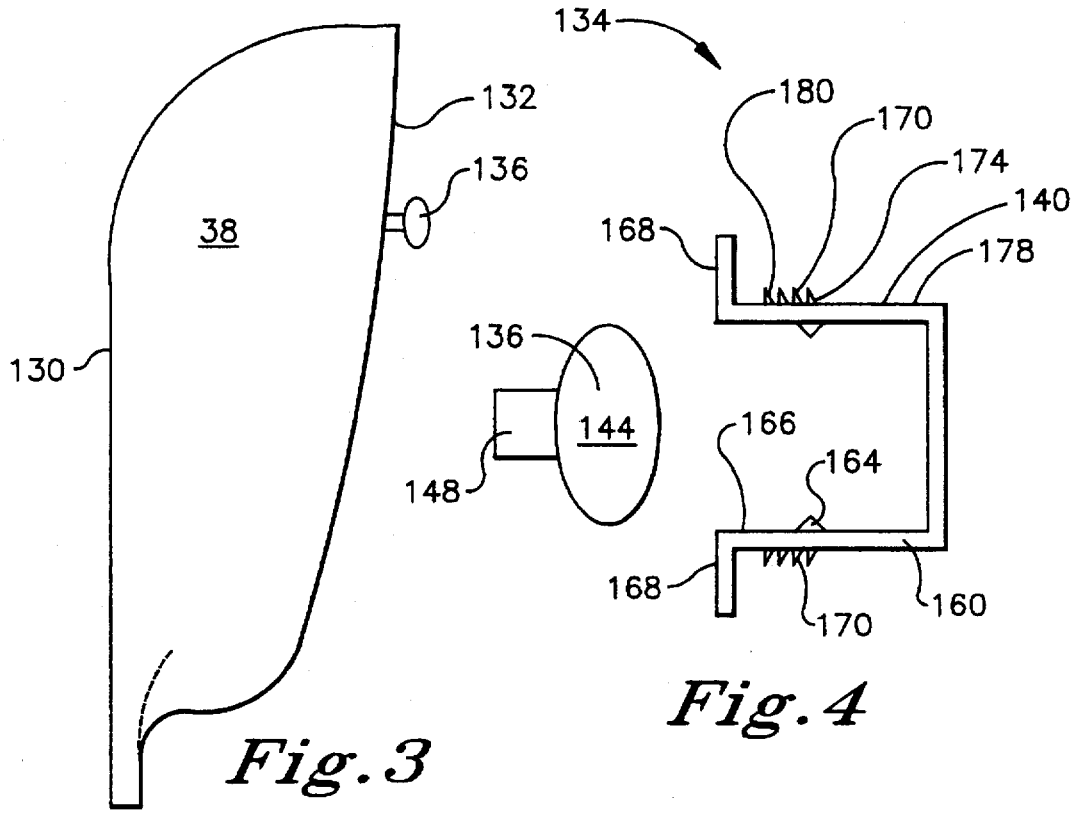
Fig. 3
Fig. 4
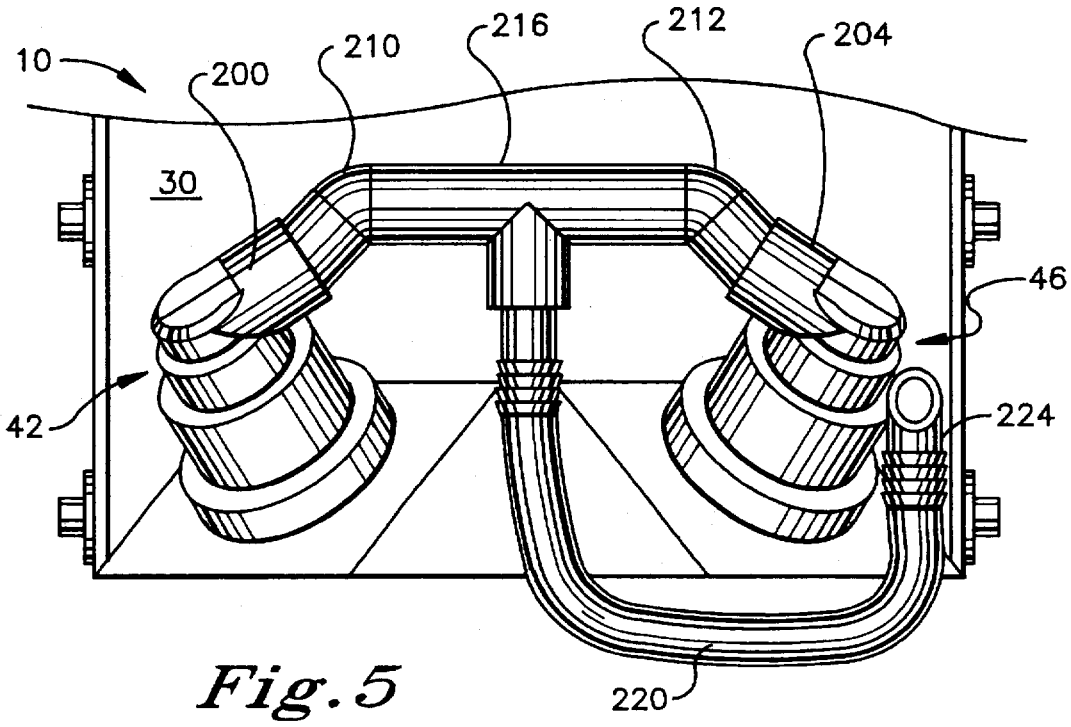
Fig. 5

HOT TUB WITH ADJUSTABLE HEADREST WITH WATER JET

CROSS-REFERENCE TO RELATED APPLICATION

This is a continuation of U.S. patent application Ser. No. 08/542,639, filed Oct. 13, 1995 and now abandoned.

BACKGROUND OF THE INVENTION

1. Technical Field

This invention relates to hot tubs or spas and, more particularly, to hot tubs or spas with an adjustable headrest having integral water jets.

2. Background

Hot tubs and spas typically include a spa shell which is made using thermal form techniques. A thermal form sheet of coextruded plastic is typically precut in a particular shape and heated. The heated thermal form sheets are then placed over a mold and vacuum pressure is applied below the mold. The thermal form sheets conform to the mold, take on the shape of the mold and harden after cooling.

While spa shells can be formed in varying sizes and shapes, the cost of designing a spa shell to accommodate a particular occupant, however, is prohibitive. Furthermore, a spa or hot tub is often used by different occupants of varying heights. Often, taller occupants are required to slouch to rest their heads against a headrest or spa ledge during spa use. Shorter occupants may not be tall enough to rest their heads against fixed headrests. Thus, a spa or hot tub which can be adjusted to fit a particular user would be desirable and advantageous.

Hydrotherapy aerated water jets have been designed to provide a turbulent mix of hot water and air under pressure for impacting an occupant of a spa or hot tub to provide a therapeutic benefit to the occupant. In the past, the aerated water jets have been positioned below the water line to minimize splash. As a result, the therapeutic benefits are limited to body parts which are typically positioned below the water line during use. Unfortunately, the neck of an occupant is typically positioned above the water line and often requires therapeutic attention. Thus, a spa or hot tub providing therapeutic benefits to the occupant's neck would also be both advantageous and desirable. Furthermore, a device providing therapeutic benefits to the occupant's neck should be adjustable to reach different parts of the occupant's neck, head and upper shoulders and to accommodate occupants of varying heights.

Despite significant advancements in the art of hot tub and spa design, there still exists a need for hot tubs or spas which provide additional therapeutic benefits and which are readily adjustable to fit occupants of varying heights.

SUMMARY OF THE INVENTION

An adjustable headrest for a spa tub according to the present invention includes a housing for supporting the head of an occupant. A spa tub defines a first recess for slidingly receiving said housing. A positioning means, coupled to said housing and said first recess of said spa tub, adjusts the height of said housing relative to said spa tub.

According to other features of the invention, a front surface of said housing and said a pillow lie flush with adjacent surfaces of said spa tub to prevent discomfort. The adjustable headrest further includes first water propelling means, mounted on said housing below said pillow, for directing water under pressure towards the neck of the occupant.

In another feature of the invention, the adjustable headrest further includes adjustment means, associated with said first water propelling means, for changing the direction of said water exiting said first water propelling means.

In another feature of the invention, the positioning means further includes a plurality of projections extending outwardly from sides of said housing and guide means, located in said first recess, for receiving said plurality of projections and for allowing said housing to be positioned in a plurality of fixed positions.

In still other features of the invention, the guide means includes first and second guide rails each defining a horizontal slot, a vertical slot and a plurality of spaced notches. An annular-shaped raised surface formed around at least one of said projections on said housing reduces friction by decreasing the surface area of said housing in contact with said first and second guide rails.

In still another feature of the invention, the adjustable headrest further includes second water propelling means, for projecting a mixture of water and air at the shoulders of the occupant.

A height-adjustable water jet for directing water at the neck of an occupant of a spa tub according to another aspect of the invention includes a housing and a water propelling means, mounted on said housing, for directing water under pressure towards the neck of the occupant. A spa tub includes a recess for slidingly receiving said housing. A positioning means, coupled to said housing and said recess of said spa tub, adjusts the height of said housing and said water propelling means and fixes the height of said housing in one of a plurality of selectable positions.

An adjustable-height headrest with water jet for a spa tub according to another aspect of the invention includes a housing having a first recess for receiving a pillow for supporting the head of an occupant. A spa tub includes a second recess for slidingly receiving said housing. A positioning means, coupled to said housing and said spa tub, adjusts the height of said housing relative to said recess of said spa tub. A water propelling means, mounted on said housing below said pillow, directs water under pressure towards the neck of the occupant.

An adjustable-height headrest with a direction-adjustable water jet for a spa tub according to still another aspect of the invention includes a housing defining a first recess for receiving a pillow for supporting the head of an occupant. A spa tub defines a second recess for slidingly receiving said housing. A positioning means, coupled to said housing and said spa tub, adjusts the height of said housing relative to said second recess of said spa tub. A water propelling means, mounted on said housing, directs water under pressure towards the neck of the occupant. An adjustment means, associated with said water propelling means, changes the direction of said water exiting said water propelling means.

Other objects, features and advantages will be readily apparent.

BRIEF DESCRIPTION OF THE DRAWINGS

The various advantages of the present invention will become apparent to those skilled in the art after studying the following specification and by reference to the drawings in which:

FIG. 2 is a perspective view of the adjustable headrest and headrest guide rails according to the present invention;

FIG. 3 is a side view of a pillow shown on the adjustable headrest of FIG. 1;

FIG. 4 is a side cross sectional view of a pillow fastener including male and female connectors for attaching the pillow of FIG. 3 to the adjustable headrest of FIG. 1;

FIG. 5 is a rear view of the adjustable headrest of FIG. 2 illustrating the plumbing for the adjustable neck water jets illustrated in FIG. 1; and FIG. 6 is a perspective view of an alternate headrest guide rail according to the present invention.

DESCRIPTION OF THE PREFERRED EMBODIMENT

Figure 1:
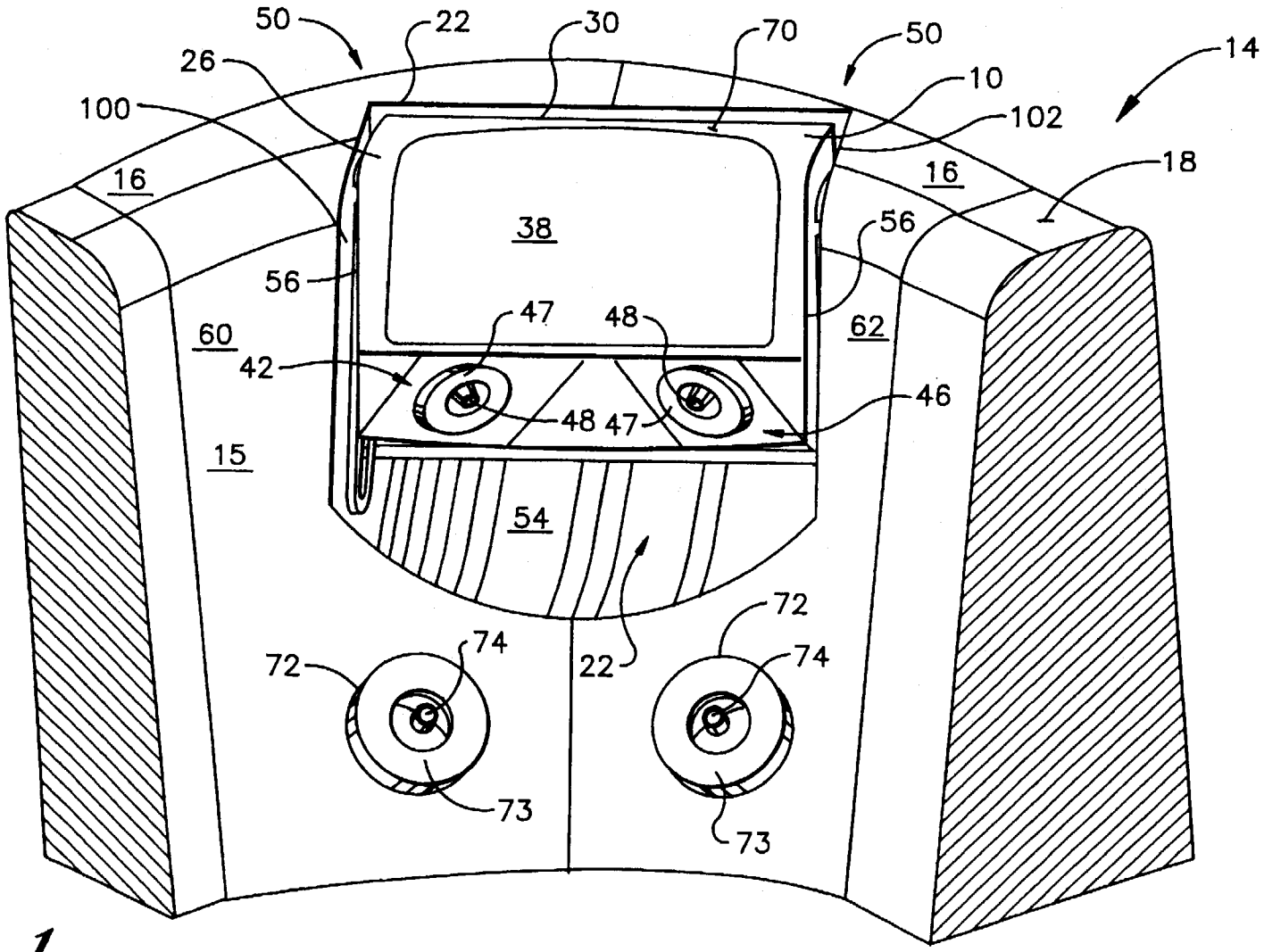
FIG. 1 is a front perspective view of a spa incorporating an adjustable headrest having integral adjustable neck water jets according to the present invention.

Referring to FIGS. 1 and 2, the presently preferred embodiment of an adjustable headrest 10 for a hot tub or spa 14 is illustrated. Spa 14 includes a spa shell 18 which defines a seat portion (not shown), a back portion 15, and an upper ledge 16. Skilled artisans can appreciate that spa shell 18 can have many different sizes and shapes and that the shape illustrated in FIG. 1 is merely but one example. Furthermore, skilled artisans can appreciate that adjustable headrest 10 can be located in positions other than the corner position of spa 14 illustrated in FIG. 1. Spa shell 18 defines a first recess 22 for receiving adjustable headrest 10. First recess 22 of FIG. 1 preferably has an elongate rectangular cross-section and provides sufficient clearance to allow adjustable headrest 10 to be raised and lowered relative to spa shell 18.

Adjustable headrest 10 includes a front side 26 and a rear side 30. An upper portion of front side 26 of adjustable headrest 10 defines a second recess 34 (FIG. 2) for receiving a headrest pillow 38. Adjustable headrest 10 further includes first and second water jets 42 and 46 which are located below pillow 10 on a lower portion of front side 26. First and second water jets 42 and 46, preferably located above a water line during use, move with adjustable headrest 10 and direct a jet of water at the hot tub occupant's neck, head or upper shoulders. Preferably, first and second neck jets 42 and 46 are oriented in a downwardly facing direction to minimize water splashing outside of spa 14. First and second water jets 42 and 46 each include an outer bezel 47 which can be rotated in one direction to increase water pressure and in an opposite direction to decrease water pressure. First and second water jets 42 and 46 further include a nozzle 48 which can be adjusted to change the direction of water output therefrom.

An adjustment device 50 is located between adjustable headrest 10 and first recess 22 of spa shell 18 to allow the height of headrest 10 to be adjusted relative to spa shell 18. A concave lower portion 54 of first recess 22 provides clearance for water exiting water jets 42 and 46 when adjustable headrest 10 is in the lower positions as will be described in further detail below. Preferably, opposing front sides 56 and 58 of adjustable headrest 10 are approximately flush with adjacent surfaces 60 and 62 of spa shell 18 to provide a comfortable surface for an occupant to rest against.

Preferably, adjustable headrest 10 can be selectively and easily adjusted in a plurality of fixed-height positions relative to spa shell 18. In a highly preferred embodiment, adjustable headrest 10 can be raised to an upper position with an upper surface 70 of adjustable headrest 10 lying above ledge 16, to a lower position with upper surface 70 lying below ledge 16, and to one or more intermediate positions. Preferably in one intermediate position, upper surface 70 of adjustable headrest 10 lies flush to ledge 16.

Spa shell 18 further includes one or more water jets 72, preferably located below the water line during use, which selectively directs either water or aerated water at the shoulders of the hot tub occupant. Water jets 72 preferably include a nozzle 74 which can be directionally adjusted. Preferably water jet 72 can also be adjusted to provide variable water pressure (using outer bezel 73) and air pressure mixtures (by adjusting nozzle 74).

Referring to FIG. 2, adjustable headrest 10 and portions of adjustment device 50 are illustrated in greater detail. For purposes of clarity, reference numbers from FIG. 1 have been used where appropriate. Pillow 38 has been omitted to illustrate second recess 34. Adjustable headrest 10 further includes sides 76 and 78.

In a preferred embodiment, adjustment device 50 includes first and second guide rails 80 and 82 each having a "C"-shaped cross section. Guide rails 80 and 82 include an opening 84 into a horizontal slot 86 which is connected to a vertical slot 88. Guide rails 80 and 82 further include an upper stop 90 located in an upper portion of vertical slot 88 and a lower stop 94 located in a lower portion of vertical slot 88. Guide rails 80 and 82 include a plurality of notches 96 (the bottom-most notch corresponds to lower stop 94).

A plurality of fasteners connect first and second guide rails 80 and 82 to opposing flat surfaces 100 and 102 of first recess 22 (FIG. 1). In a preferred embodiment, first and second guide rails 80 and 82 include a plurality of bores 98 for receiving screws (not shown).

Adjustment device 50 further includes upper and lower projections 106 and 108 extending outwardly from sides 76 and 78 of adjustable headrest 10. Projections 106 and 108 are slidably received in horizontal and vertical slots 86 and 88 of first and second guide rails 80 and 82. In a highly preferred embodiment, adjustable headrest 10 includes first and second raised annular surfaces 114 and 116 surrounding projections 106 and 108. First and second raised annular surfaces 114 and 116 reduce sliding friction by decreasing the surface area of sides 76 and 78 in contact with first and second guide rails 80 and 82, respectively.

Referring to FIGS. 2, 3 and 4, front and rear surfaces 130 and 132 of pillow 38 are illustrated. A fastening device 134 connects pillow 38 to adjustable headrest 10. Fastening device 134 preferably includes one or more male connectors 136 which are connected to and extend rearwardly from a rear surface 132 of pillow 38. One or more female connectors 140 are received in a bore formed in adjustable headrest 10 (FIG. 2). Skilled artisans can appreciate that the position of male and female connectors 136 and 140 can be switched. In other words, male connector 136 can be located on adjustable headrest 10 and female connector 140 can be located on rear surface 132 of pillow 38.

In a highly preferred embodiment, male connector 140 includes an oval shaped upper portion 144 connected to a cylindrical base 148 having a smaller outer diameter than the oval upper portion 144. Female connector 140 resembles a top hat and includes a cylindrical housing 160 having an annular projection 164 on an inner surface 166 thereof. Female connector 140 includes an annular flange 168 and a plurality of raised notches 170 having a leading surface 174 which is inclined relative to an outer surface 178 of the female connector 140. A trailing surface 180 of raised notches 170 is perpendicular to outer surface 178. As can be appreciated, the force required to insert female connector 140 into the bore in adjustable headrest 10 is markedly less than the force required to remove female connector 140. Thus, female connector 140 remains in position when pillow 38 is repeatedly attached to and detached from adjustable headrest.

Referring to FIG. 5, rear side 30 of adjustable headrest 10 is illustrated. Water jets 42 and 46 include a jet body 200 and 204, respectively. Because nozzles 48 of water jets 42 and 46 are located above the water line, preferably air is not introduced. Elbow connectors 210 and 212 and a "T"-shaped connector 216 join plumbing to jet bodies 200 and 204. A corrugated section of tubing 220 and an elbow connector 224 couple jet bodies 200 and 204 to a back wall of first recess 22 of spa shell 18. A source of pressurized water is preferably located beneath spa shell 18 and is connected to elbow connector 224.

In a highly preferred embodiment, spa shell 18 is fabricated using conventional thermal form techniques. Adjustable headrest 10 and guide rails 42 and 46 are made from injection molded plastic. Water jets 42 and 46 (modified by removing air inputs) are manufactured by Waterway Plastics, Inc. of Oxnard, Calif. Outer bezels 47 thereof can be rotated to increase or decrease water pressure of water jets 42 and 46. Nozzle 48 of water jets 42 and 46 can be pivoted to adjust the direction of the water.

Preferably, water jets 72 are manufactured by Hydroflex, Inc of Orange, Calif. An outer bezel 73 of water jet 72 can be rotated to increase or decrease output water pressure. Nozzle 74 of water jets 72 can be pivoted to adjust the direction of the water. By moving the nozzle 74 inwardly and outwardly, the air pressure can be decreased or increased. Water jets 72 can also be made in accordance with "Adjustable Spa Nozzle", U.S. Ser. No. 08/147,171, hereby incorporated by reference.

In use, adjustable headrest 10 is removably connected in recess 22 of spa shell 18. To connect adjustable headrest 10, lower projections 108 on opposite sides 76 and 78 are consecutively inserted into openings 84, horizontal slots 86, and vertical slots 88 of first and second guide rails 80 and 82. Lower projections 108 are initially moved in an inwardly direction into horizontal slots 86. Then, lower projections 108 are moved in a downwardly direction into vertical slots 88 until upper projection 106 can be inserted in opening 84 and horizontal slot 86. Once upper projection 106 reaches vertical slot 88, the height of adjustable headrest 10 can be readily adjusted to properly fit the occupant. The adjustable headrest 10 is held in place by positioning lower projection 108 in notches 96.

When upper projections 106 lie adjacent upper stop 90 and lower projections 108 are in the upper notch 96, adjustable headrest 10 is in the highest position. When lower projection 108 abuts the lowest notch 94, adjustable headrest 10 is in the lowest position. Preferably when lower projections 108 are positioned in notches 96, upper projections 106 are not aligned with horizontal slot 86 to prevent forward movement of adjustable headrest 10.

As can be appreciated from the foregoing, the present invention provides a headrest which can be readily adjusted to accommodate occupants of differing heights. Advantageously, the adjustable headrest includes water jets which are likewise readily adjustable to accommodate occupants of differing heights. By allowing adjustment, the spa tub according to the present invention improves the effectiveness of the hydrotherapy. The adjusting mechanism for the headrest is easy to use. Adjustment can be made by someone inside or outside of the spa. Adjustments can be made quickly and without tools. The outer front surface of the pillow is relatively flush with the spa shell for comfort.

Referring to FIG. 6, an alternate guide rail 300 according to the present invention is illustrated. Like guide rails 80 and 82, guide rail 300 has a "C"-shaped cross section. Skilled artisans can appreciate that a second guide rail similar to (or a mirror image of) guide rail 300 would be employed. Guide rail 300 includes an opening 304 and a horizontal slot 306 connected to a vertical slot 308. Guide rail 300 further includes an upper stop 310 and a lower stop 312 located at opposite ends of vertical slot 308. Vertical slot 308 further includes a plurality of upwardly-facing notches 316, a plurality of downwardly-facing notches 320, and a center notch 324. As with guide rails 80 and 82, a plurality of fasteners connect guide rails 300 to opposing flat surfaces 100 and 102 of first recess 22 (FIG. 1). In a preferred embodiment, the fasteners screws (not shown) are received in bores 330.

When using guide rails 300, adjustable headrest 10 can likewise be positioned at a plurality of different fixed heights relative to spa shell 18. To connect adjustable headrest 10 using guide rails 300, lower projections 108 on opposite sides 76 and 78 are consecutively inserted through opening 304, into horizontal slot 306, and into vertical slot 308 of guide rail 300. Lower projections 108 are moved in a downwardly direction until upper projection 106 can be aligned with opening 304 and into horizontal slot 306. Once upper projection 106 reaches vertical slot 308, the height of adjustable headrest 10 can be readily adjusted to support an occupant's head and be held in place using notches 96. When upper projection 106 lies adjacent upper stop 310 in notch 316', the lower projection 116 snap-fits into center notch 324 and adjustable headrest 10 is in the highest position. When lower projection 108 lies adjacent lower stop 312 in the lowest notch 320', the upper projection 106 snap-fits into center notch 324 and adjustable headrest 10 is in the lowest position. When lower projection 108 lies in the notches 320 above the lowest notch 320', the upper projection 106 snap-fits into notches 316 above center notch 324 and adjustable headrest 10 is in an intermediate position.

As can be appreciated, guide rail 300 allows adjustable headrest 10 to be more readily held in a fixed position by snap-fitting into a fixed position and by providing a more positive "locked" feel.

Various other advantages of the present invention will become apparent to those skilled in the art after having the benefit of studying the foregoing text and drawings, taken in conjunction with the following claims.

What is claimed is:

1. An adjustable head rest for a spa tub comprising:

a spa tub defining a spa tub recess;

a pillow;

a housing slidingly received by said spa tub recess for supporting the head of an occupant, wherein said housing has a front surface, a back surface, two side surfaces laterally disposed between said front surface and said back surface, and a housing recess for receiving said pillow, wherein said front surface and said pillow lie flush with adjacent surfaces of said spa tub; and positioning means, coupled to said housing and located in said spa tub recess, for adjusting the height of said housing relative to said spa tub, wherein said positioning means includes a projection extending outwardly from one of said side surfaces of said housing and a guide means, located in said spa tub recess opposite said one of said side surfaces, for receiving said projection and for allowing said housing to be positioned in a plurality of fixed positions.

2. An adjustable head rest for a spa tub comprising:

a spa tub defining a spa tub recess;

a pillow;

a housing slidingly received by said spa tub recess for supporting the head of an occupant having a front surface, a back surface, two side surfaces laterally disposed between said front surface and said back surface, and a housing recess for receiving said pillow;

positioning means, coupled to said housing and located in said spa tub recess, for adjusting the height of said housing relative to said spa tub, wherein said positioning means includes a projection extending outwardly from one of said side surfaces of said housing and a guide means, located in said spa tub recess opposite said one of said side surfaces, for receiving said projection and for allowing said housing to be positioned in a plurality of fixed positions; and water propelling means, mounted on said housing below said pillow, for directing water under pressure downward into contact with the neck of the occupant.

3. The adjustable headrest of claim 2 wherein said water propelling means is located above a water line when said spa tub is in use.

4. The adjustable headrest of claim 2 further comprising:

adjustment means, associated with said first water propelling means, for changing the direction of said water under pressure relative to said housing.

5. The adjustable headrest of claim 1 wherein said guide means is a first guide means and said projection is a first projection, and further wherein the positioning means additionally includes:

a second projection extending outwardly from the other of said side surfaces of said housing; and a second guide means, located in said spa tub recess opposite the other of said side surfaces, for receiving said second projection and for allowing said housing to be positioned in a plurality of fixed positions.

6. An adjustable headrest for a spa tub comprising:

a spa tub defining a spa tub recess;

a housing slidingly received by said spa tub recess for supporting the head of an occupant having a front surface, a back surface, and two side surfaces laterally disposed between said front surface and said back surface;

positioning means, coupled to said housing and located in said spa tub recess, for adjusting the height of said housing relative to said spa tub, wherein said positioning means includes a projection extending outwardly from one of said side surfaces of said housing and a guide means, located in said spa tub recess opposite said one of said side surfaces, for receiving said projection and for allowing said housing to be positioned in a plurality of fixed positions, and further wherein said guide means includes a substantially planar guide rail defining a horizontal slot, a vertical slot and a plurality of spaced notches, said horizontal slot, said vertical slot and said plurality of notches all formed within a common plane.

7. The adjustable head rest of claim 6 wherein said guide means snap-fits said adjustable head rest in said plurality of fixed positions.

8. An adjustable headrest for a spa tub comprising:

a spa tub defining a spa tub recess;

a housing slidingly received by said spa tub recess for supporting the head of an occupant having a front surface, a back surface, and two side surfaces laterally disposed between said front surface and said back surface;

positioning means, coupled to said housing and located in said spa tub recess, for adjusting the height of said housing relative to said spa tub, wherein said positioning means includes a projection extending outwardly from one of said side surfaces of said housing and a guide means, located in said spa tub recess opposite said one of said side surfaces, for receiving said projection and for allowing said housing to be positioned in a plurality of fixed positions, and further wherein said guide means includes a substantially planar guide rail including a horizontal slot, a vertical slot, a first plurality of upwardly facing notches, a second plurality of downwardly facing notches, and a central notch, said horizontal slot, vertical slot, first plurality of upwardly facing notches, second plurality of downwardly facing notches, and central notch all formed within a common plane.

9. The adjustable headrest of claim 6 wherein said guide rail is mounted to said spa tub in said spa tub recess.

10. The adjustable headrest of claim 6 further comprising:

an annular-shaped raised surface formed around said projection on said housing for reducing friction by decreasing the surface of said housing in contact with said guide rail.

11. The adjustable headrest of claim 1 further comprising:

mixture propelling means, mounted in said spa tub for projecting a mixture of water and air at the shoulders of the occupant.

12. A height-adjustable water jet for directing water at the neck of an occupant of a spa tub, comprising:

a housing;

water propelling means, mounted on said housing, for directing water under pressure into contact with the neck of the occupant;

a spa tub including a recess for slidingly receiving said housing; and positioning means, coupled to said housing and said recess of said spa tub, for adjusting the height of said housing and said water propelling means and for fixing the height of said housing in one of a plurality of selectable positions.

13. The height-adjustable water jet of claim 12 further comprising:

adjustment means, associated with said water propelling means, for changing the direction of said water under pressure relative to said housing.

14. The adjustable headrest of claim 12 wherein said housing has a front surface, a back surface and two side surfaces laterally disposed between said front surface and said back surface and further wherein said positioning means includes:

a projection extending outwardly from one of said side surfaces of said housing; and a guide rail, located in said first recess opposite said one of said side surfaces, for receiving said projection and for allowing said housing to be positioned in a plurality of fixed positions.

15. The adjustable headrest of claim 14 wherein said guide rail is mounted to said spa tub in said recess.

16. The adjustable headrest of claim 15 wherein said guide rail is substantially planar and defines a horizontal slot, a vertical slot and a plurality of notches, said horizontal slot, vertical slot, and plurality of notches all formed within a common plane.

17. An adjustable-height headrest with water jet for a spa tub comprising:

a housing having a first recess for receiving a pillow for supporting the head of an occupant;

a spa tub including a second recess for slidingly receiving said housing;

positioning means, coupled to said housing and said spa tub, for adjusting the height of said housing relative to said recess of said spa tub; and water propelling means, mounted on said housing below said pillow, for directing water under pressure in contact with the neck of the occupant.

18. An adjustable-height headrest with water jet for a spa tub comprising:

a housing defining a first recess for receiving a pillow for supporting the head of an occupant;

a spa tub defining a second recess for slidingly receiving said housing;

positioning means, coupled to said housing and said spa tub, for adjusting the height of said housing relative to said second recess of said spa tub;

water propelling means, mounted on said housing, for directing water under pressure in contact with the neck of the occupant; and adjustment means, associated with said water propelling means, for changing the direction of said water under pressure relative to said housing.

* * * * *